US009759524B2

(12) United States Patent
Culp

(10) Patent No.: US 9,759,524 B2
(45) Date of Patent: Sep. 12, 2017

(54) ADJUSTABLE FIREARM SCOPE MOUNTING SYSTEMS

(71) Applicant: Mark Culp, Madeira, OH (US)

(72) Inventor: Mark Culp, Madeira, OH (US)

( * ) Notice: Subject to any disclaimer, the term of this patent is extended or adjusted under 35 U.S.C. 154(b) by 0 days.

(21) Appl. No.: 15/192,334

(22) Filed: Jun. 24, 2016

(65) Prior Publication Data

US 2016/0377385 A1 Dec. 29, 2016

Related U.S. Application Data

(60) Provisional application No. 62/183,933, filed on Jun. 24, 2015.

(51) Int. Cl.
*F41G 11/00* (2006.01)

(52) U.S. Cl.
CPC ..... *F41G 11/003* (2013.01); *F41G 11/001* (2013.01); *F41G 11/005* (2013.01)

(58) Field of Classification Search
CPC .... F41G 11/001; F41G 11/004; F41G 11/005; F41G 11/006; F41G 11/007
USPC ..... 42/126, 125, 111, 115, 119, 120, 124, 42/127
See application file for complete search history.

(56) References Cited

U.S. PATENT DOCUMENTS 2,548,031 A * 4/1951 Leupold ..... F41G 11/001 403/188
2,663,083 A * 12/1953 Harms ..... F41G 11/001 42/126
2,775,817 A * 1/1957 Schuman ..... F41G 11/004 42/125
3,979,848 A * 9/1976 Ackerman, Jr. ..... F41G 1/26 42/126
4,205,473 A * 6/1980 Wilson ..... F41G 11/006 42/127
4,353,180 A * 10/1982 Wilson ..... F41G 11/006 42/127
4,397,107 A * 8/1983 Holden ..... F41G 11/006 42/126
5,428,915 A * 7/1995 King ..... F41G 1/387 42/126
5,433,010 A * 7/1995 Bell ..... F41G 11/003 42/122

(Continued)

*Primary Examiner* — John D Cooper
(74) *Attorney, Agent, or Firm* — Wood Herron & Evans LLP

(57) ABSTRACT

An adjustable firearm scope mounting assembly includes first and second mounting members, each including a base portion fixable relative to a firearm, and an upper portion configured to support a respective scope portion. The first upper portion is selectively adjustable relative to the first base portion in vertical and lateral directions. The second upper portion is selectively adjustable relative to the second base portion in a vertical direction. In one embodiment, one of the first base portion or the first upper portion includes a vertically extending element movable along an arcuate path within a vertically extending socket defined by the other of the first base portion or the first upper portion. In another embodiment, the first and second mounting members include bearing elements that encircle the first and second scope portions and facilitate angular movement of the firearm scope relative to the upper portions when at least one of the upper portions is moved vertically relative to its respective base portion.

20 Claims, 9 Drawing Sheets

(56) References Cited

U.S. PATENT DOCUMENTS

| | | | | |
|---|---|---|---|---|
| 6,708,439 | B1 * | 3/2004 | Laitala | F41G 11/002 42/124 |
| 7,121,037 | B2 * | 10/2006 | Penney | F41G 11/001 42/126 |
| 7,543,405 | B1 * | 6/2009 | Ivey | F41G 11/003 42/125 |
| 8,079,171 | B2 * | 12/2011 | Barrett | F41G 1/38 42/125 |
| 8,240,075 | B1 * | 8/2012 | Mullin | F41G 1/38 42/119 |
| 8,327,574 | B2 * | 12/2012 | Sandler | F41G 11/003 42/126 |
| 8,533,988 | B2 * | 9/2013 | Ziegler | F41G 11/007 42/124 |

* cited by examiner

ADJUSTABLE FIREARM SCOPE MOUNTING SYSTEMS

CROSS-REFERENCE TO RELATED APPLICATION

This application claims priority to U.S. Provisional Application Ser. No. 62/183,933, filed Jun. 24, 2015, the disclosure of which is hereby incorporated by reference herein in its entirety.

TECHNICAL FIELD

This invention relates generally to firearm scope mounting systems useful for long and short-range shooting and, more particularly, to such systems that are adjustable for target distance and windage.

BACKGROUND

Most modern rifle scopes include a reticle that is internally adjustable by the user, using scope turrets, in both vertical and horizontal planes to a "zero" point at a known distance from a target. A windage turret controls internal adjustment of the reticle laterally (i.e., left and right) to account for changes in windage, and an elevation turret controls internal adjustment of the reticle vertically to account for changes in target distance (also referred to as "elevation").

A rifle scope is typically mounted to a rifle using two or more mounting rings that clamp around the tube of the scope and hold the scope at a fixed distance above the barrel bore of the rifle. Conventional scope mounting rings are available in a variety of fixed heights to accommodate a number of factors, including diameter of the scope's objective lens, profile of the barrel, height of any mounting device or base used between the scope rings and the rifle, and the comb height of the stock where the user rests ("welds") his cheek to align his eye with the scope for proper sighting. While scope mounting rings are available in a wide variety of heights, the height is fixed and the user generally must select only one height dimension or purchase multiple sets of scope mounting rings to accommodate different installations or to allow the scope mounted on different rifles.

Internal adjustment of the reticle is typically adequate to allow a "zero" adjustment at short to moderate ranges. However, at longer ranges (e.g., beyond one thousand yards), this internal adjustment may be inadequate, especially to compensate for lateral misalignment between the barrel bore and axis of the scope or mounting rings. Further, an initial "zero" of a scope mounted to a rifle is generally set at either an indoor range or other place where environmental conditions are controlled and there is no cross wind. In an ordinary scope mounting system, lateral angular adjustment is done by way of the internal adjustment of the reticle using the scope's adjustment turrets. In some cases, especially where the longitudinal orientation of the mounting base is not perfectly parallel to the bore axis of the rifle barrel, a significant portion of the lateral "windage" adjustment is used to set the "zero" position of the scope, thus leaving little adjustment range available for fine-tuning in the field.

Previous attempts to provide adjustable scope mounting rings have proved inadequate in various ways, including lacking sufficient strength and rigidity to maintain precise alignment under the heavy recoil impact of larger caliber rifles commonly used to shoot at long ranges. Accordingly, there is a need for improvements to known scope mounting devices that address these and other shortcomings.

SUMMARY

An adjustable firearm scope mounting assembly according to an exemplary embodiment of the invention includes first and second mounting members attachable to a firearm. The first mounting member includes a first base portion fixable relative to the firearm, and a first upper portion configured to support a first scope portion of a firearm scope. The first upper portion is selectively adjustable relative to the first base portion in vertical and lateral directions. One of the first base portion or the first upper portion includes a vertically extending element movable along an arcuate path within a vertically extending socket defined by the other of the first base portion or the first upper portion. The second mounting member includes a second base portion fixable relative to the firearm, and a second upper portion configured to support a second scope portion of the firearm scope. The second upper portion is selectively adjustable relative to the second base portion in a vertical direction.

An adjustable firearm scope mounting assembly according to another exemplary embodiment of the invention also includes first and second mounting members attachable to a firearm. The first mounting member includes a first base portion fixable relative to the firearm, and a first upper portion configured to support a first scope portion of a firearm scope. The first upper portion is selectively adjustable relative to the first base portion in vertical and lateral directions, and includes a first bearing element that encircles the first scope portion. The second mounting member includes a second base portion fixable relative to the firearm, and a second upper portion configured to support a second scope portion of the firearm scope. The second upper portion is selectively adjustable relative to the second base portion in a vertical direction, and includes a second bearing element that encircles the second scope portion. The first and second bearing elements are configured to facilitate angular movement of the firearm scope relative to the first and second upper portions when at least one of the first or second upper portions is moved vertically relative to its respective base portion.

Various additional features and advantages of the invention will become more apparent to those of ordinary skill in the art upon review of the following detailed description of illustrative embodiments taken in conjunction with the accompanying drawings. The drawings, which are incorporated in and constitute a part of this specification, illustrate exemplary embodiments of the invention and, together with the general description given above and the detailed description given below, serve to explain the exemplary embodiments.

BRIEF DESCRIPTION OF THE DRAWING

Like reference numerals are used to indicate like parts throughout the various figures of the drawing, wherein.

DETAILED DESCRIPTION

Figure 1:
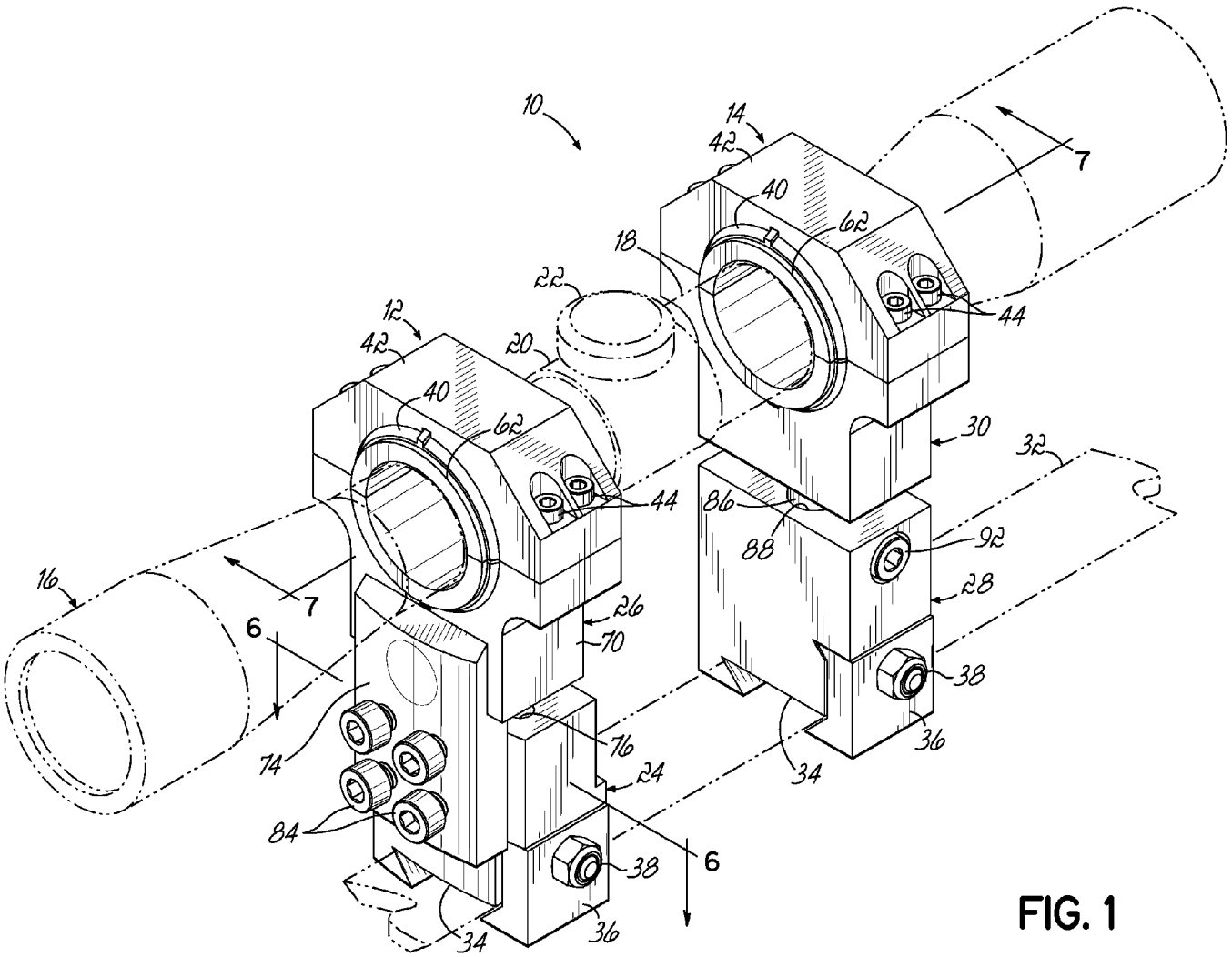
FIG. 1 is a forward isometric view of an adjustable firearm scope mounting system according to an exemplary embodiment of the present invention, with a firearm scope and a firearm mounting rail shown in phantom.
Figure 2:
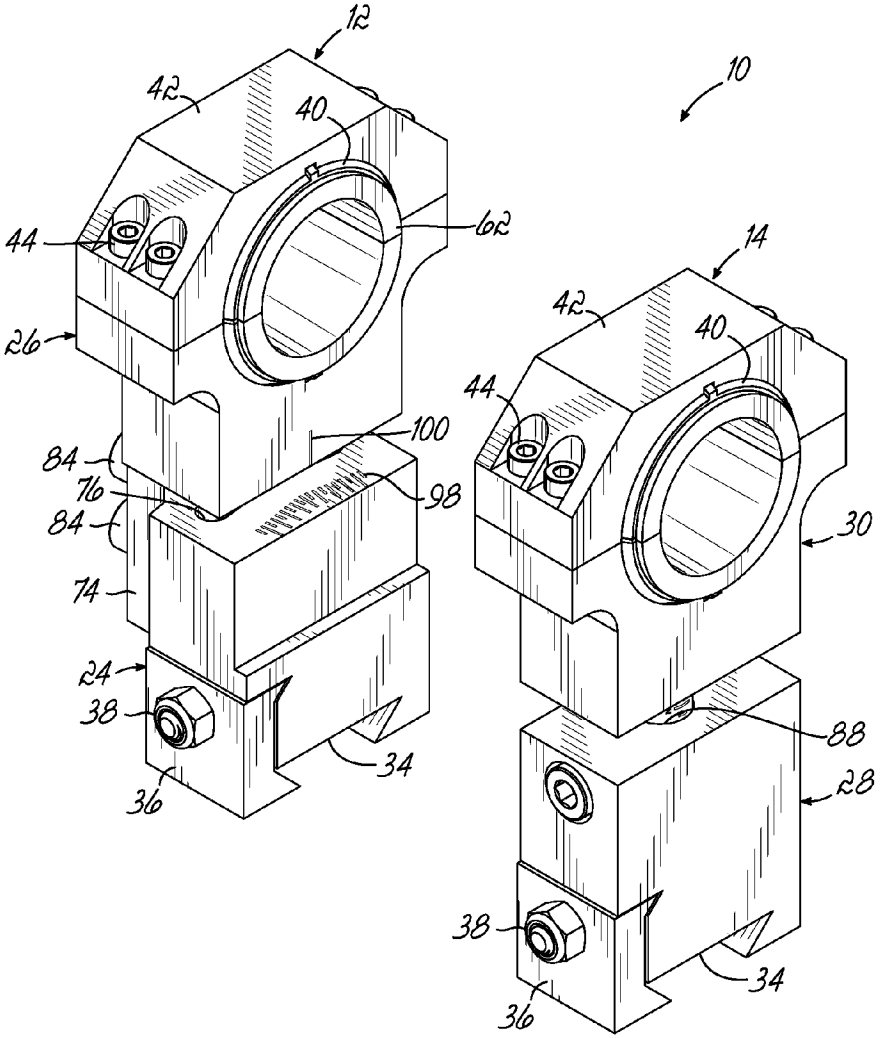
FIG. 2 is a rear isometric of the system of FIG. 1.

Referring now to FIGS. 1 and 2, therein is shown at 10 an exemplary embodiment of an adjustable firearm scope mounting system of the present invention. The mounting system 10 generally includes a forward mounting member 12 and a rear mounting member 14. In this embodiment, the forward and rear mounting members 12, 14 are in the form of scope rings that mount to a firearm to support a firearm scope 16 at locations along a scope tube 18 forward and rearward of a scope saddle 20, on which reticle adjustment turrets 22 are arranged.

The forward mounting member 12 includes a body having a base portion 24 fixable relative to a firearm, and an upper portion 26 coupled and movable relative to the base portion 24 for supporting a forward portion of the scope tube 18. Similarly, the rear mounting member 14 includes a body having a base portion 28 and an upper portion 30 coupled and movable relative to the base portion 28 for supporting a rear portion of the scope tube 18. In one embodiment, as shown in FIG. 1, the base portions 24, 28 may removably and adjustably mount to a firearm mounting rail 32 (shown schematically in phantom), which may be in the form of a standard Picatinny (1913 MIL-STD) rail, for example. The mounting rail 32 may be captured in a dovetail groove 34 at the bottom of each base portion 24, 28, and clamped in place with a mounting wedge 36 that is held and tightened with a threaded fastener 38. In other embodiments, the base portions 24, 28 may mount to alternative locations and mounting points on a firearm.

As described in greater detail below, the forward upper portion 26 is selectively adjustable vertically and laterally relative to the forward base portion 24. Additionally, the rear upper portion 30 is selectively adjustable vertically relative to the rear base portion 28, and automatically pivots relative to the rear base portion 28 to accommodate lateral adjustments made with the forward mounting member 12. Further, each mounting member 12, 14 includes a bearing ring 40 that facilitate angular movements of the scope 16 relative to the forward and rear upper portions 26, 30 when at least one of the upper portions 26, 30 is adjusted. In this manner, the mounting system 10 enables a coarse, initial alignment of the scope 16 with a target without using windage and elevation turrets on the scope saddle 20 (see, e.g., turret 22). Accordingly, and advantageously, a full range of internal reticle adjustment provided by the scope turrets 22 is preserved for use in the field for making fine-tune adjustments to scope alignment.

Figure 3:
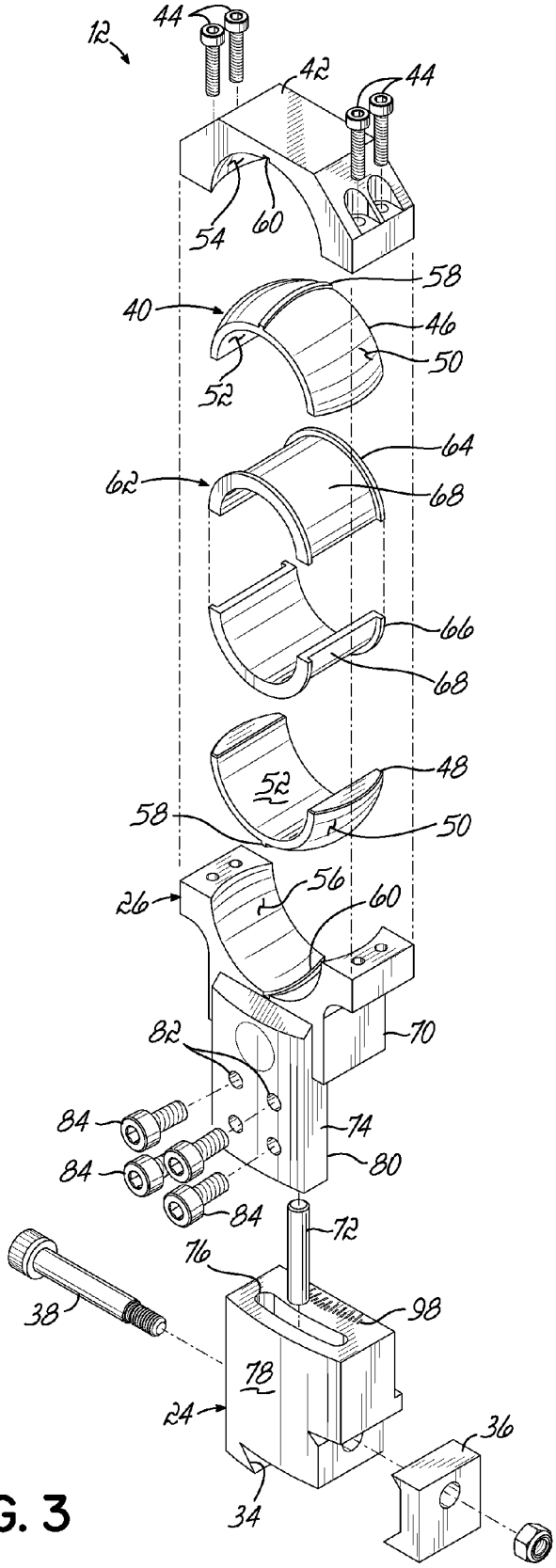
FIG. 3 is an exploded forward isometric view of a forward mounting member of the system of FIG. 1.
Figure 4:
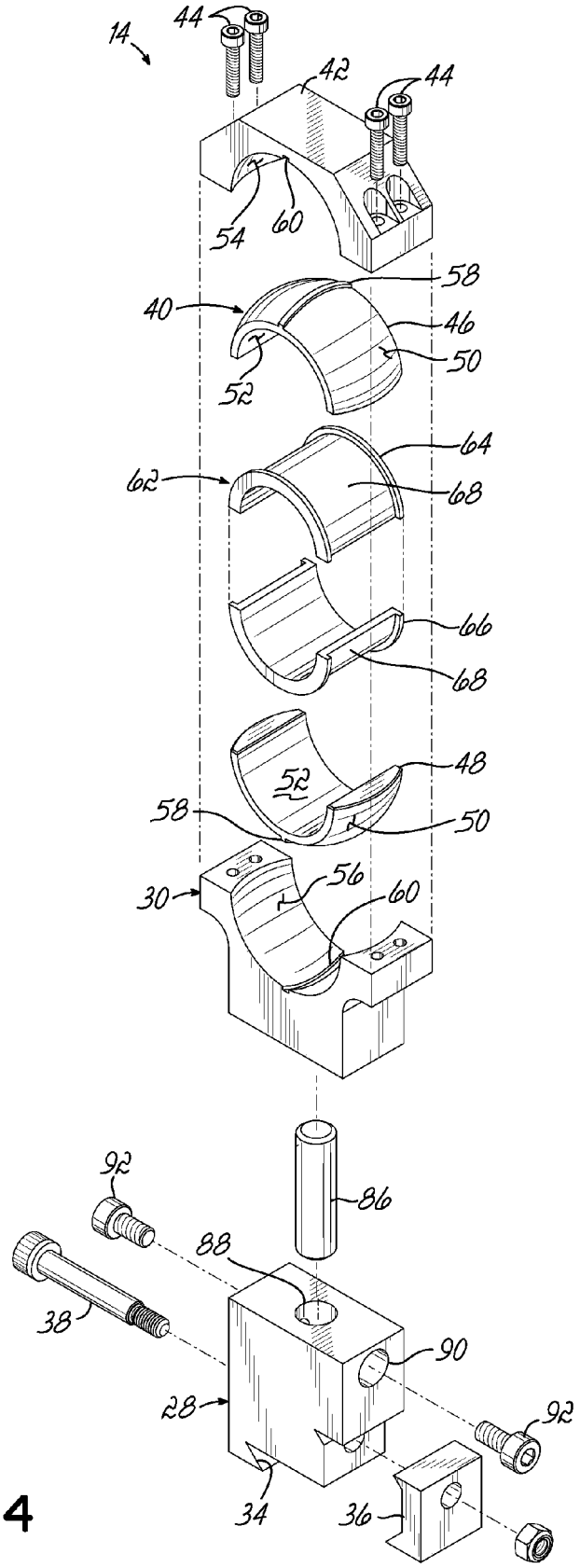
FIG. 4 is an exploded forward isometric view of a rear mounting member of the system of FIG. 1.

Referring to FIGS. 3 and 4, components of the forward and rear mounting members 12, 14 are shown in greater detail. Starting at their upper ends, each mounting member 12, 14 includes a removable upper clamping cap 42 that removably attaches with screws 44 to clamp a respective forward or rear portion of the scope tube 18 against the upper portion 26, 30 of the respective mounting member 12, 14.

Each mounting member 12, 14 also includes a bearing ring 40 comprising upper and lower bearing inserts 46, 48 that, when assembled, define a collar that encircles the scope 16, as shown in FIG. 1. Each bearing insert 46, 48 includes a convex spherical outer surface 50 and a cylindrical inner surface 52. The convex spherical outer surface 50 of the upper bearing insert 46 confronts and slidably engages an upper concave spherical cradle surface 54 formed in an underside of the respective clamping cap 42. The convex spherical outer surface 50 of the lower bearing insert 48 confronts and slidably engages a lower concave spherical cradle surface 56 formed in an upper side of the respective upper portion 26, 30.

Each of the upper and lower bearing inserts 46, 48 includes an alignment rib 58 that extends axially along the spherical outer surface 50 at a position that generally bisects the bearing insert 46, 48 vertically. In the embodiment shown, the alignment ribs 58 are arranged at diametrically opposed positions along a vertical plane extending through the bearing ring 40. Further, each of the upper and lower cradle surfaces 54, 56 includes an alignment groove 60 that is aligned with and slidably receives the alignment rib 58 of the respective bearing insert 46, 48. In alternative embodiments, though not shown, one or both of the alignment ribs 58 may be formed on the respective cradle surface 54, 56 and the corresponding alignment groove 60 may be formed in the spherical outer surface 50 of the respective bearing insert 46, 48. It will be appreciated that in further alternative embodiments, the alignment ribs 58 and alignment grooves 60 may be omitted from the mounting members 12, 14.

Engagement of the alignment ribs 58 with the alignment grooves 60 guides movement of the bearing rings 40 relative to the upper portions 26, 30. In particular, as described below in connection with FIGS. 7A-7C, each bearing ring 40 pivots relative to the respective upper portion 26, 30 about a respective lateral axis that extends generally transverse to a longitudinal axis defined by the forward and rear mounting members 12, 14 (e.g., a longitudinal axis of the scope 16). It will be appreciated that in alternative embodiments, the bearing rings 40 may be omitted from the scope mounting system 10.

Each mounting member 12, 14 may further include a sizing ring 62 comprising upper and lower sizing inserts 64, 66 that, when assembled, define a collar that encircles the scope 16, as shown in FIG. 1. The sizing inserts 64, 66 may be positioned radially between the scope 16 and the bearing inserts 46, 48, and each includes an outer cylindrical recess 68 that receives the cylindrical inner surface 52 of a respective bearing insert 46, 48. The sizing inserts 64, 66 may be formed with a radial wall thickness suitable to enable the mounting system 10 to accommodate a scope tube 18 of any desired diameter, such as one inch or 30 millimeters, for example. For scopes 16 having tubes 18 of particularly large diameter, the sizing inserts 64, 66 may be entirely omitted from the mounting system 10. Additionally, the sizing inserts 64, 66 may be made of any suitable elastomeric or rigid material, as desired.

While the bearing inserts 46, 48 and sizing inserts 64, 66 are shown in the form of first and second semi-cylindrical halves (i.e., 180 degree segments), it will be appreciated that they may be reconfigured in various alternative quantities that combine to form an annular shape defining the bearing ring 40 and sizing ring 62.

Referring to FIG. 3, the upper portion 26 of the forward mounting member 12 includes a main body 70 on which the lower cradle surface 56 is formed, and from which a vertically extending alignment post 72 and an attachment flange 74 depend downwardly. The alignment post 72 may be pressed into a vertically extending bore formed in an underside of the forward upper portion 26 (see FIG. 7A). The alignment post 72 may be generally cylindrical with a circular cross-section, or alternatively may be formed with various other cross-sectional shapes. The attachment flange 74 may be integrally formed with, or otherwise rigidly secured to, the main body 70.

The base portion 24 of the forward mounting member 12 includes an alignment socket 76 that extends vertically through an upper side of the forward base portion 24, and laterally along an arcuate path positioned centrally so as to span equally across a vertical symmetry line passing through the forward base portion 24. The alignment post 72 of the forward upper portion 26 is slidably received within the alignment socket 76 and is movable vertically and laterally, as described below, to permit positional adjustment of the forward upper portion 26 relative to the forward base portion 24. The forward base portion 24 also includes a convex curved front face 78 that confronts a concave curved rear face 80 of the attachment flange 74 of the forward upper portion 26.

Figure 6A:
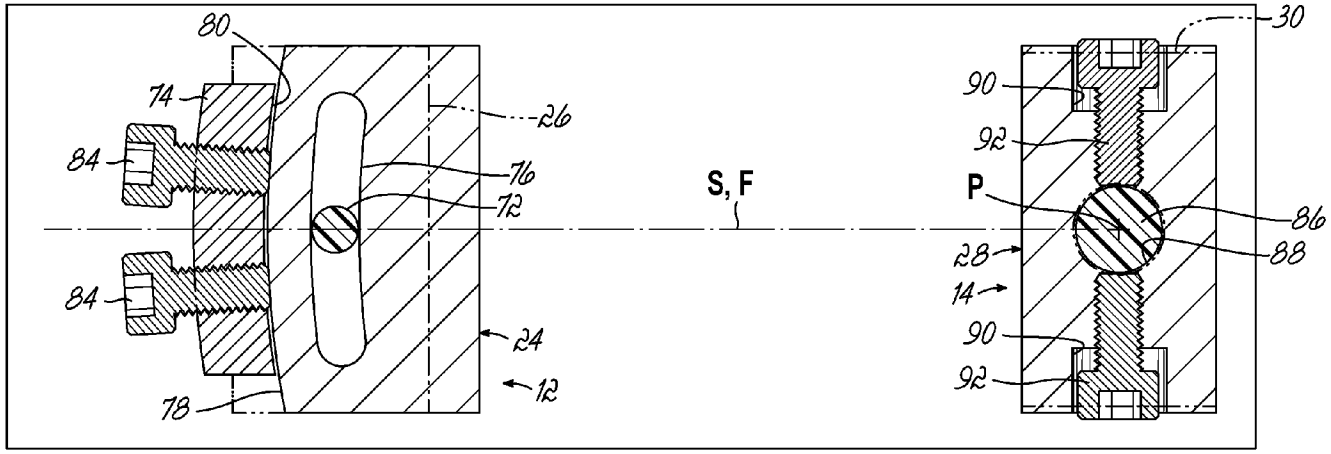
FIG. 6A is a top cross-sectional view taken along line 6-6 in FIG. 1, showing an upper portion of the forward mounting member in an exemplary first lateral position relative to its base portion.
Figure 6B:
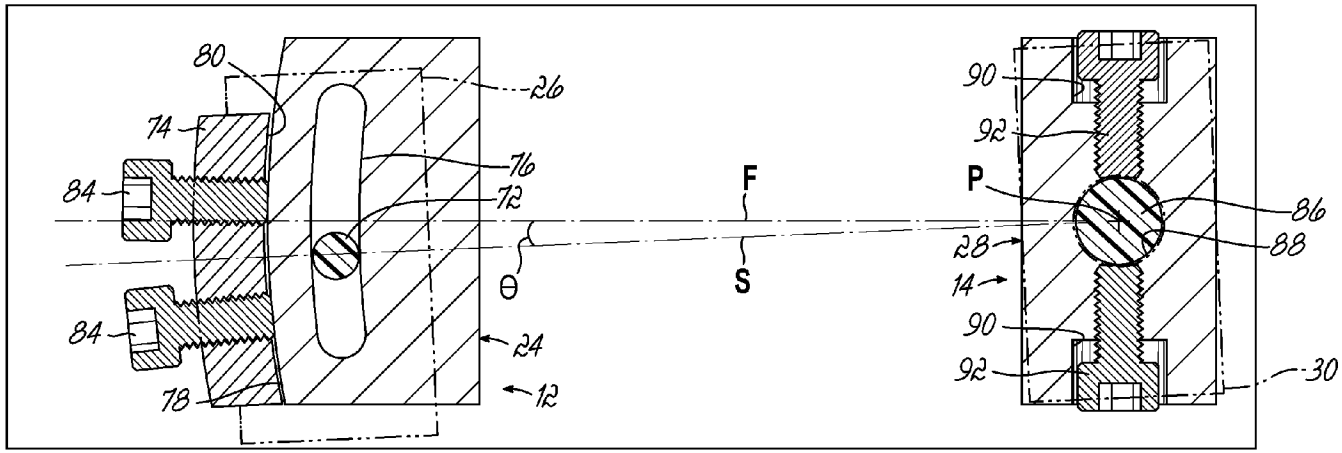
FIG. 6B is a top cross-sectional view similar to FIG. 6A, showing the forward upper portion in an exemplary second lateral position relative to its base portion.

Referring momentarily to FIGS. 6A and 6B, the arcuate alignment socket 76 and curved front face 78 of the forward base portion 24, and the attachment flange 74 of the forward upper portion 26, extend laterally along arcuate paths that have matching curvatures and are substantially concentric about a vertical pivot axis P defined by the rear mounting member 14, described below. Accordingly, the curvature of the curved rear face 80 of the attachment flange 74 complements the curvature of the curved front face 78 of the forward base portion 24. This configuration facilitates and guides lateral adjustment of the forward upper portion 26 relative to the forward base portion 24 along the concentric arcuate paths defined by the alignment socket 76, the curved front face 78, and the curved rear face 80. During such movement, the alignment post 72 moves arcuately laterally within the alignment socket 76 while the attachment flange 74 slides arcuately laterally along the curved front face 78 of the forward base portion 24. The curved front face 78 may substantially contact or be in very close proximity to the curved rear face 80 of the attachment flange 74 during such movement.

Returning to FIG. 3, the attachment flange 74 of the forward upper portion 26 may further include a plurality of openings 82 that receive a corresponding plurality of securing elements that fix a position of the forward upper portion 26 relative to the forward base portion 24. In the illustrated embodiment, the securing elements are shown in the form of threaded fasteners 84 that threadedly engage and extend through the openings 82. As best shown in FIGS. 6A and 6B, the openings 82 and threaded fasteners 84 may be oriented radially toward the vertical pivot axis P of the rear mounting member 14. The threaded fasteners 84 may be tightened so that their distal ends clamp against the convex curved front face 78 of the forward base portion 24, thereby positionally fixing the forward upper portion 26 vertically and laterally. In alternative embodiments, the position of the forward upper portion 26 relative to the forward base portion 24 may be selectively adjusted and fixed using mechanical adjustment elements and fasteners of various other types known in the art.

While the exemplary embodiment shown and described herein includes the attachment flange 74 and alignment post 72 depending downwardly from the forward upper portion 26, and the arcuate alignment socket 76 formed in the forward base portion 24, it will be appreciated that various alternative configurations of these components may be employed. For example, though not shown, the alignment socket 76 may be formed in the forward upper portion 26 and one or both of the alignment post 72 and the attachment flange 74 may extend upwardly from the forward base portion 24.

Referring to FIG. 4, showing a disassembled view of the rear mounting member 14, the rear upper portion 30 includes a vertically downward depending pivot post 86. The pivot post 86 may be pressed into a vertically extending bore formed in an underside of the rear upper portion 30 (see FIG. 7A). The rear base portion 28 includes a vertically extending pivot socket 88 extending centrally through an upper side thereof. The pivot socket 88 is sized to slidably and pivotably receive therein the pivot post 86, and defines the pivot axis P about which the rear upper portion 30 and pivot post 86 freely pivot. In this manner, when the forward upper portion 26 is adjusted laterally relative to the forward base portion 24, the rear upper portion 30 automatically pivots (via forces exerted by the scope 16) about the pivot axis P so that the rear upper portion 30 remains coaxially aligned with the forward upper portion 26. Further, as described in greater detail below in connection with FIGS. 7A-7C, the pivot post 86 is vertically movable within the pivot socket 88 for adjusting a vertical spacing between the rear upper portion 30 and the rear base portion 28.

The rear base portion 28 may further include a pair of bores 90 extending laterally through opposing sides of the rear base portion 28. As shown best in FIGS. 6A and 6B, the laterally opposed bores 90 extend toward one another and include distal ends that open to the vertically extending pivot socket 88 and the pivot post 86 disposed therein. Each bore 90 receives a respective securing element that fixes a position of the forward upper portion 26 relative to the forward base portion 24. In the illustrated embodiment, the securing elements are shown in the form of threaded fasteners 92 that threadedly engage and extend through the bores 90, and are tightened so that their distal ends clamp against the pivot post 86, thereby positionally fixing the rear upper portion 30 vertically and pivotally. In alternative embodiments, the position of the rear upper portion 30 relative to the rear base portion 28 may be selectively adjusted and fixed using mechanical adjustment elements and fasteners of various other types known in the art.

While the exemplary embodiment shown and described herein includes the pivot post 86 depending downwardly from the rear upper portion 30 and the pivot socket 88 formed in the rear base portion 28, it will be appreciated that a reverse configuration may be employed.

Figure 5B:
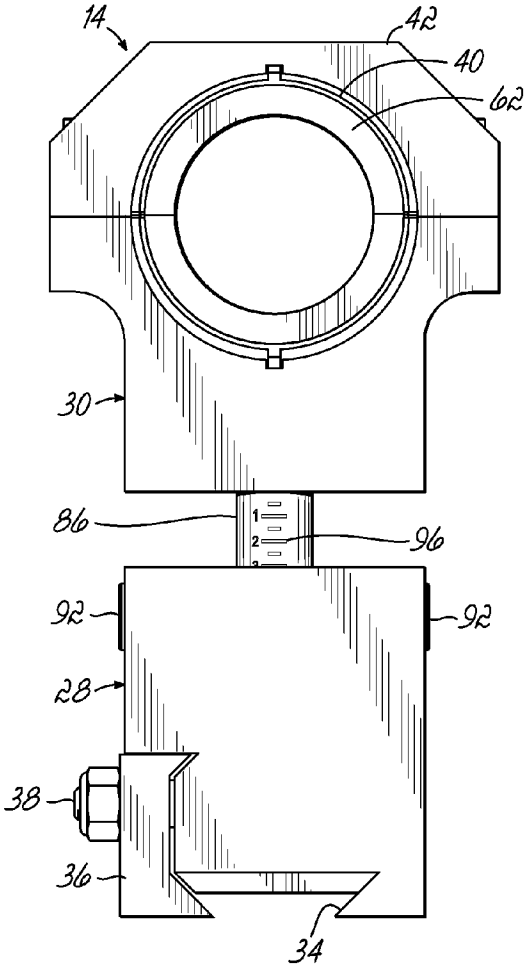
FIG. 5B is a rear elevation view of the rear mounting member.
Figure 5A:
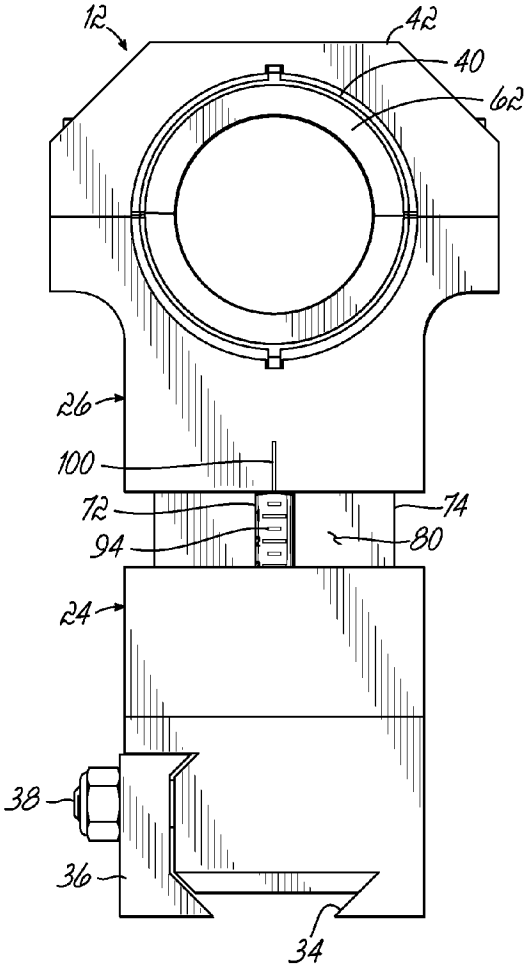
FIG. 5A is a rear elevation view of the forward mounting member.

As shown in FIG. 5A, a rearwardly facing surface of the alignment post 72 of the forward mounting member 12 may be provided with indicia 94 (e.g., scale) for indicating a vertical spacing, or height, between the forward upper portion 26 and the forward base portion 24. Similarly, as shown in FIG. 5B, a rearwardly facing surface of the pivot post 86 of the rear mounting member 14 may be provided with indicia 96 (e.g., scale) for indicating a vertical spacing, or height, between the rear upper portion 30 and the rear base portion 28. The forward mounting member 12 may further include indicia (e.g., scale) on its base and upper portions 24, 28 for indicating a lateral position of the upper portion 28 relative to the base portion 24. For example, as shown best in FIGS. 2, 3, and 5A, the forward base portion 24 may include multiple indicia markings 98 and the forward upper portion 26 may include a single indicia marking 100 that slides laterally relative to the multiple indicia markings 98.

In an exemplary embodiment, the forward mounting member 12 and rear mounting member 14 are assembled into an adjustable scope mounting system 10 by first attaching the base portions 24, 28 to the firearm or mounting rail 32 at preselected longitudinally spaced apart positions. The posts 72, 86 of the upper portions 26, 30 are then inserted into the sockets 76, 88 of their respective base portions 24, 28. The lower bearing and sizing inserts 48, 66 are then positioned on the upper portions 26, 30, and the scope tube 18 is rested within the lower sizing inserts 66, or alternatively within the lower bearing inserts 48 if the sizing inserts 64, 66 are omitted. The upper bearing and sizing inserts 46, 64 are then installed on top of the scope tube 18 in alignment with the lower inserts 48, 66, so as to encircle the scope tube 18. The scope 16 is then firmly clamped into place by assembling the upper clamping caps 42 onto the upper portions 26, 30. At this stage of assembly, the longitudinal spacing of the forward and rear mounting members 12, 14 relative to the scope 16 and to the firearm is fixed. However, the upper portions 26, 30 remain positionally adjustable relative to the base portions 24, 28, as described below.

Referring to FIGS. 6A and 6B, angular adjustment of the scope 16 in a horizontal plane is achieved by sliding the forward upper portion 26 laterally relative to the forward base portion 24. As described above, the alignment post 72 slides arcuately within the alignment socket 76, while the attachment flange 74 slides arcuately along the curved front face 78 of the forward base portion 24. Simultaneously, the rear upper portion 30 pivots relative to the rear base portion 28 about vertical pivot axis P. In this manner, any desired gross windage angle θ between a longitudinal scope axis S and a longitudinal firearm axis F (e.g., a barrel axis), in a horizontal plane, may be achieved. More particularly, a lateral angular position of the scope 16 may be infinitely adjustable in increments smaller than the one-quarter or one-eighth minute of angle (MOA), for example, provided by internal adjustment of the reticle using scope turrets 22.

Figure 7A:
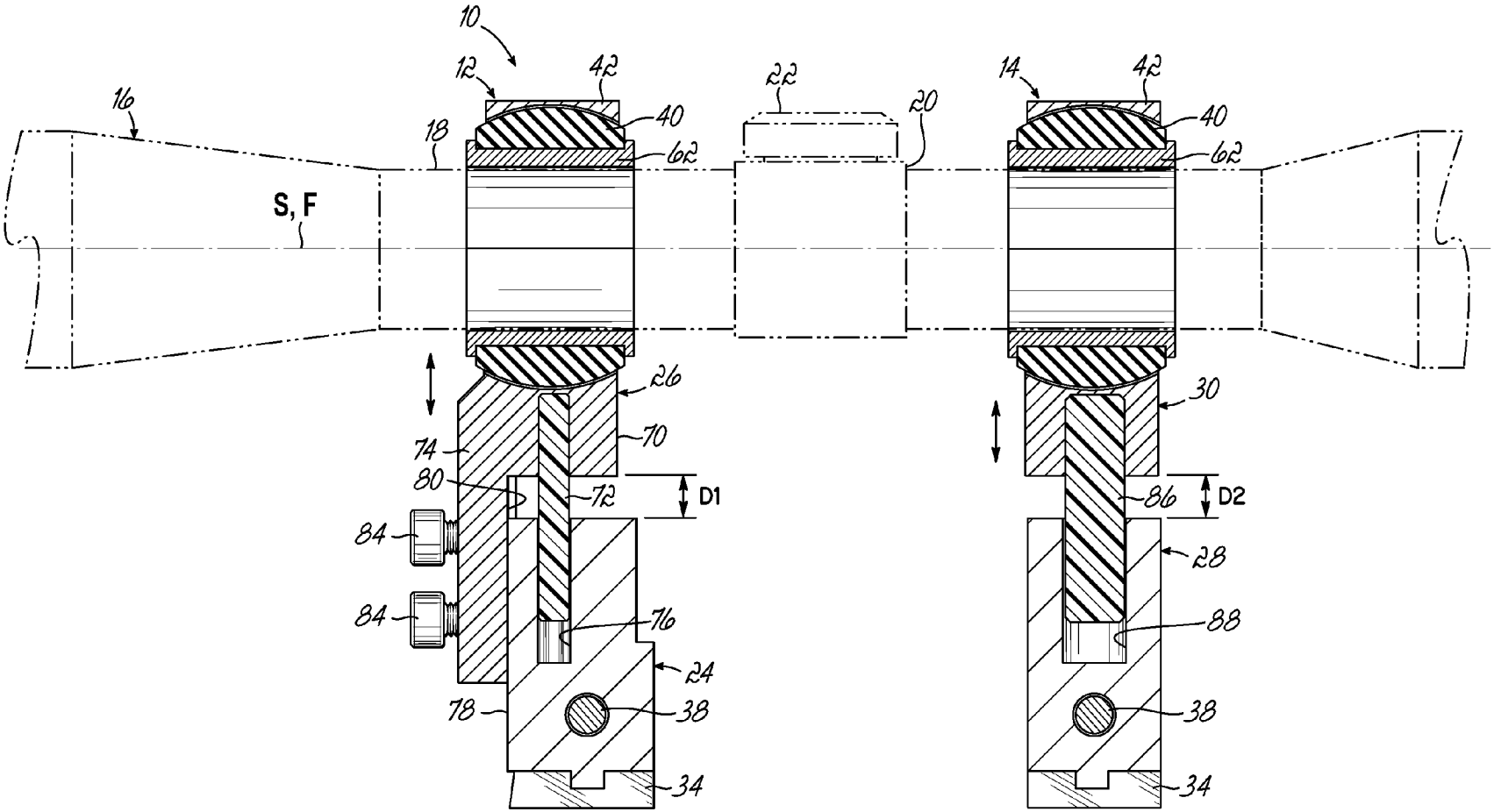
FIG. 7A is a side cross-sectional view taken along line 7-7 in FIG. 1, showing upper portions of the forward and rear mounting members in exemplary vertical positions for supporting the firearm scope in a generally level orientation.
Figure 7B:
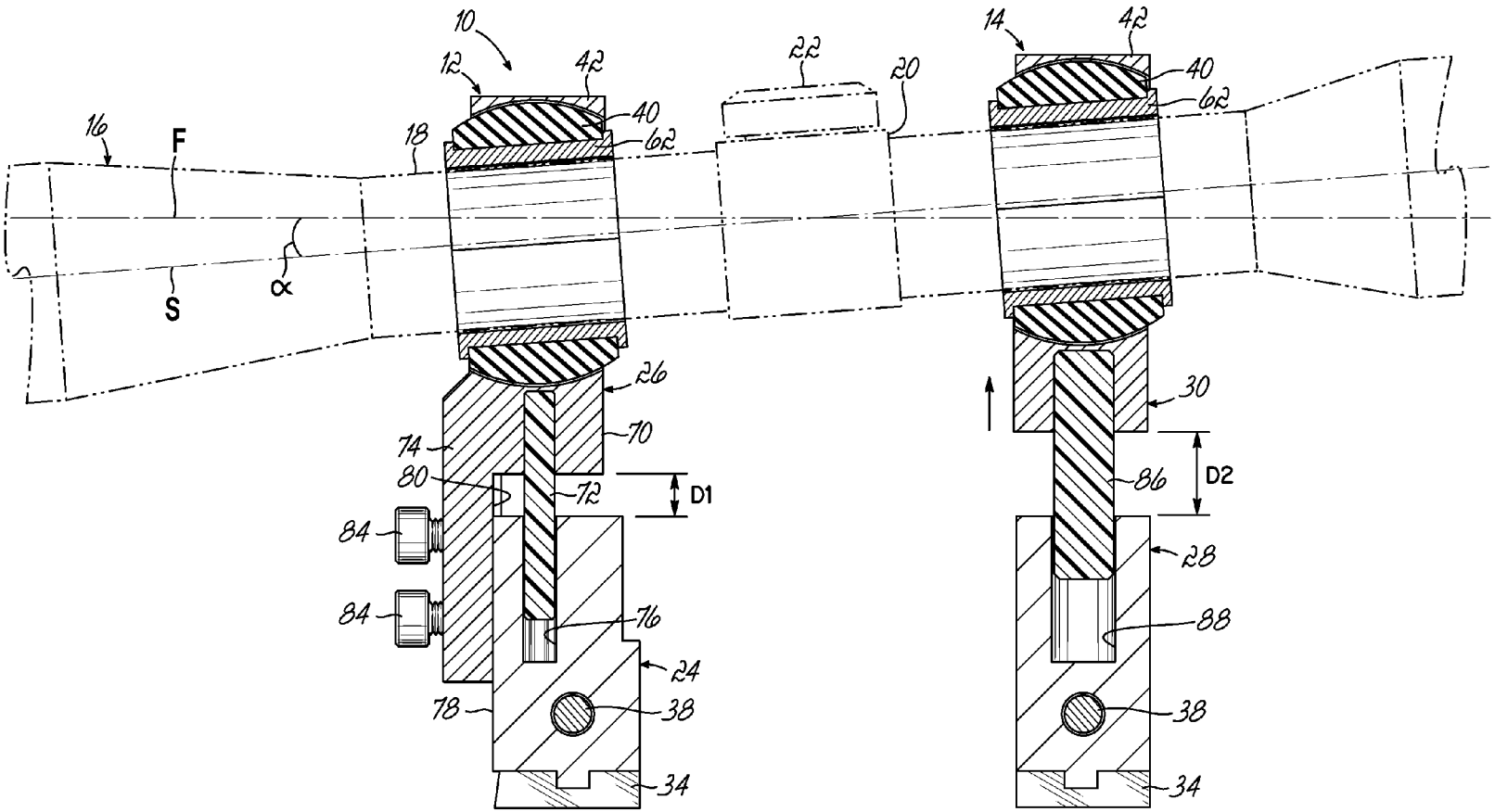
FIG. 7B is a side cross-sectional view similar to FIG. 7A, showing the upper portions in exemplary vertical positions for supporting the firearm scope in an exemplary nose-down orientation.
Figure 7C:
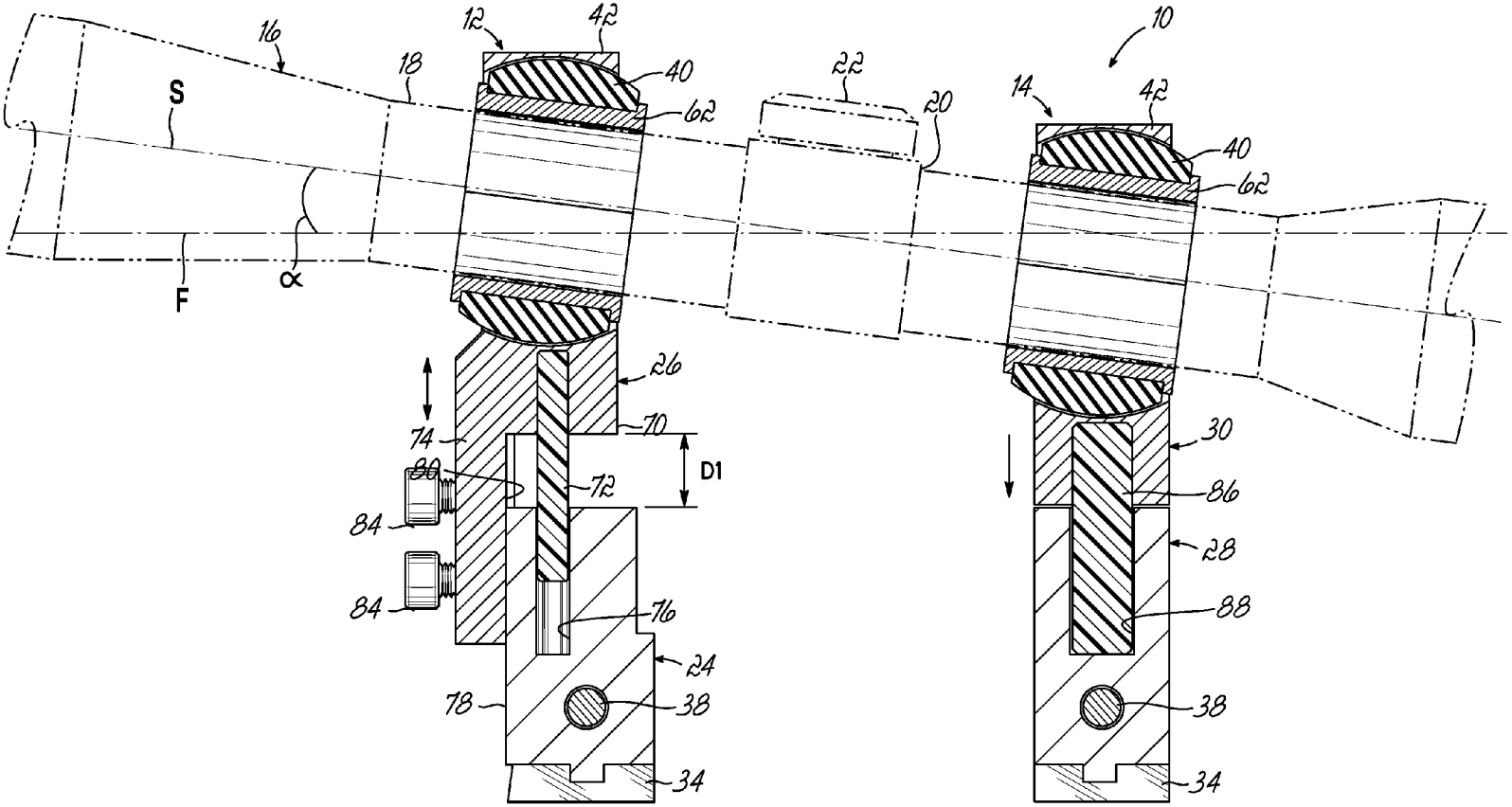
FIG. 7C is a side cross-sectional view similar to FIG. 7B, showing the upper portions in exemplary vertical positions for supporting the firearm scope in an exemplary nose-up orientation.

Referring to FIGS. 7A-7C, exemplary adjustment of the scope 16 in a vertical plane is shown in greater detail. The upper portions 26, 30 may be selectively spaced vertically from their respective base portions 24, 28 by respective distances D1 and D2, as desired. For example, as shown in FIG. 7A, the scope 16 may be supported in a generally level orientation by positioning the upper portions 26, 30 so that the vertical spacings D1, D2 are substantially equal. As shown in FIG. 7B, the scope 16 may be supported in a generally negative-attitude, or "nose-down," orientation by positioning the upper portions 26, 30 so that the rear vertical spacing D2 is greater than the forward vertical spacing D1. This exemplary orientation provides a negative gross elevation angle a between the longitudinal scope axis S and the longitudinal firearm axis F in a vertical plane. As shown in FIG. 7C, the scope 16 may be supported in a generally positive-attitude, or "nose-up," orientation by positioning the upper portions 26, 30 so that the forward vertical spacing D1 is greater than the rear vertical spacing D2. This exemplary orientation provides a positive gross elevation angle a between the longitudinal scope axis S and the longitudinal firearm axis F in a vertical plane.

As shown in FIG. 7C, a nose-up orientation of the scope 16 may be achieved in one embodiment by fully lowering the rear upper portion 30 so as to directly contact the rear base portion 28 (thereby reducing D2 to zero), while placing the forward upper portion 26 in a raised position. Similarly, though not shown, a nose-down orientation of the scope 16 (e.g., similar to that shown in FIG. 7B) may be achieved by fully lowering the forward upper portion 26 to directly contact the forward base portion 24 (thereby reducing D1 to zero), while placing the rear upper portion 30 in a raised position. Moreover, it will be appreciated that the vertical spacings D1, D2 of the upper portions 26, 30 may be suitably arranged to achieve any desired gross elevation angle a between the longitudinal scope axis S and the longitudinal firearm axis F.

As shown in FIGS. 7B and 7C, when the upper portions 26, 30 are positioned at different heights above their respective base portions 24, 28 (i.e., when D1 and D2 are unequal), the bearing rings 40 pivot about respective lateral axes relative to the upper portions 26, 30. More specifically, as described above with reference to FIGS. 3 and 4, the spherical outer surfaces 50 of the bearing rings 40 slide relative to the upper and lower cradle surfaces 54, 56, and the alignment ribs 58 are guided within the alignment grooves 60. This pivoting motion provided by the bearings 40 enables the forward and rear upper portions 26, 30 to remain coaxially aligned with the longitudinal scope axis S, and with one another. Advantageously, this substantially reduces mutual stresses exerted between the scope tube 18 and the upper portions 26, 30 when the upper portions 26, 30 are positioned at different heights D1, D2 (i.e., when the scope 16 is positioned in a nose-up or nose-down orientation).

Once the desired vertical and lateral adjustments to the front and rear mounting members 12, 14 have been made, the upper portions 26, 30 may be positionally and releasably fixed by tightening the threaded fasteners 84 extending through the attachment flange 74 of the forward base portion 24, and the threaded fasteners 92 extending through the laterally opposed sides of the rear base portion 28. Additional adjustments to scope alignment may be performed thereafter as desired by disengaging the fasteners 84, 92, further adjusting the upper portions 26, 30, and then retightening the fasteners 84, 92.

While one exemplary embodiment of the present invention has been described in detail, it should be apparent that modifications and variations thereto are possible, all of which fall within the scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. An adjustable firearm scope mounting system, comprising:

first and second mounting members attachable to a firearm;

the first mounting member including a first base portion fixable relative to the firearm, and a first upper portion configured to support a first scope portion of a firearm scope, the first upper portion being selectively adjustable relative to the first base portion in vertical and lateral directions, and one of the first base portion or the first upper portion including a vertically extending element movable along an arcuate path within a vertically extending socket defined by the other of the first base portion or the first upper portion; and the second mounting member including a second base portion fixable relative to the firearm, and a second upper portion configured to support a second scope portion of the firearm scope and being selectively adjustable relative to the second base portion in a vertical direction.

2. The adjustable firearm scope mounting system of claim 1, wherein the first mounting member is a forward mounting member configured to support a forward scope portion of the firearm scope, and the second mounting member is a rear mounting member configured to support a rear scope portion of the firearm scope.

3. The adjustable firearm scope mounting system of claim 1, wherein the vertically extending socket extends laterally along an arcuate path.

4. The adjustable firearm scope mounting system of claim 1, wherein the vertically extending socket is formed in the first base portion and the vertically extending element includes a post depending downwardly from the first upper portion.

5. The adjustable firearm scope mounting system of claim 1, wherein one of the first upper portion or the first base portion includes a vertically extending flange that confronts and is movable along a curved face of the other of the first upper portion or the first base portion, the vertically extending flange having a curvature that complements a curvature of the curved face.

6. The adjustable firearm scope mounting system of claim 5, wherein the vertically extending flange depends downwardly from the first upper portion and the curved face is formed on the first base portion.

7. The adjustable firearm scope mounting system of claim 5, further comprising:

a securing element received through an opening formed in the vertically extending flange and configured to selectively engage the curved face for fixing a position of the first upper portion relative to the first base portion.

8. The adjustable firearm scope mounting system of claim 1, wherein the second upper portion is pivotable about a vertical axis relative to the second base portion.

9. The adjustable firearm scope mounting system of claim 8, wherein one of the second upper portion or the second base portion includes a second vertically extending socket and the other of the second upper portion or the second base portion includes a vertically extending post that is pivotably and vertically movable within the vertically extending socket.

10. The adjustable firearm scope mounting system of claim 9, wherein the second vertically extending socket is formed in the second base portion and the vertically extending post depends downwardly from the second upper portion.

11. The adjustable firearm scope mounting system of claim 1, wherein the first and second upper portions are independently movable in vertical directions relative to the first and second base portions.

12. The adjustable firearm scope mounting system of claim 1, wherein the first mounting member includes a first bearing element that encircles the first scope portion and the second mounting member includes a second bearing element that encircles the second scope portion, the first and second bearing elements configured to facilitate angular movement of the firearm scope relative to the first and second upper portions when at least one of the first or second upper portions is moved vertically relative to its respective base portion.

13. The adjustable firearm scope mounting system of claim 12, wherein each of the first and second bearing elements includes a convex spherical outer surface that confronts a concave spherical cradle surface of the respective first or second upper portion.

14. The adjustable firearm scope mounting system of claim 12, wherein each of the first and second bearing elements is pivotable about a respective lateral axis extending transverse to a longitudinal axis defined by the first and second mounting members.

15. The adjustable firearm scope mounting system of claim 12, wherein for each of the first and second mounting members, one of the respective bearing element or the respective upper portion includes an alignment rib and the other of the respective bearing element or the respective upper portion includes an alignment groove that slidably receives the alignment rib to guide movement of the bearing element relative to the upper portion.

16. An adjustable firearm scope mounting system, comprising:

first and second mounting members attachable to a firearm;

the first mounting member including a first base portion fixable relative to the firearm, and a first upper portion configured to support a first scope portion of a firearm scope, the first upper portion being selectively adjustable relative to the first base portion in vertical and lateral directions and including a first bearing element that encircles the first scope portion; and the second mounting member including a second base portion fixable relative to the firearm, and a second upper portion configured to support a second scope portion of the firearm scope, the second upper portion being selectively adjustable relative to the second base portion in a vertical direction and including a second bearing element that encircles the second scope portion, wherein the first and second bearing elements are configured to facilitate angular movement of the firearm scope relative to the first and second upper portions when at least one of the first or second upper portions is moved vertically relative to its respective base portion.

17. The adjustable firearm scope mounting system of claim 16, wherein the first mounting member is a forward mounting member configured to support a forward scope portion of the firearm scope, and the second mounting member is a rear mounting member configured to support a rear scope portion of the firearm scope.

18. The adjustable firearm scope mounting system of claim 16, wherein each of the first and second bearing elements includes a convex spherical outer surface that confronts a concave spherical cradle surface of the respective first or second upper portion.

19. The adjustable firearm scope mounting system of claim 16, wherein each of the first and second bearing elements is pivotable about a respective lateral axis extending transverse to a longitudinal axis defined by the first and second mounting members.

20. The adjustable firearm scope mounting system of claim 16, wherein for each of the first and second mounting members, one of the respective bearing element or the respective upper portion includes an alignment rib and the other of the respective bearing element or the respective upper portion includes an alignment groove that slidably receives the alignment rib to guide movement of the bearing element relative to the upper portion.

* * * * *